US005086574A

United States Patent [19]

Bacchiocchi

[11] Patent Number: 5,086,574

[45] Date of Patent: Feb. 11, 1992

[54] IMPACT DAMPING SYSTEM APPLICABLE TO SPORT SHOES

[75] Inventor: Alberto Bacchiocchi, Sao Paulo, Brazil

[73] Assignee: Sao Paulo Alpargatas, S.A., Sao Paulo SP, Brazil

[21] Appl. No.: 692,773

[22] Filed: Apr. 26, 1991

Related U.S. Application Data

[63] Continuation of Ser. No. 429,802, Oct. 30, 1990, abandoned.

[30] Foreign Application Priority Data

Nov. 25, 1988 [BR] Brazil ..... 8806281

[51] Int. Cl.[5] ..... A43B 13/12; A43B 21/26

[52] U.S. Cl. ..... 36/35 R; 36/28; 36/36 A; 36/37

[58] Field of Search ..... 36/28, 35 R, 36 A, 37, 36/114, 27, 7.8

[56] References Cited

U.S. PATENT DOCUMENTS

| | | | |
|---|---|---|---|
| 482,561 | 9/1892 | Parkison | 36/37 |
| 588,977 | 8/1897 | Gilbert | 36/37 |
| 863,873 | 8/1907 | Pratt | 36/37 |
| 2,078,311 | 4/1937 | Boag | 36/35 R |
| 2,299,305 | 10/1942 | Ciaio | 36/28 |
| 2,454,951 | 11/1948 | Smith | 36/35 |
| 3,237,320 | 5/1966 | Couture | 36/35 R |
| 3,267,592 | 8/1966 | Champion | 36/35 R |
| 3,668,792 | 6/1972 | York | 36/114 X |
| 4,342,158 | 8/1982 | McMahon et al. | 36/25 R |
| 4,494,321 | 10/1985 | Lawlor | 36/28 |
| 4,616,431 | 10/1986 | Dassler | 36/28 |
| 4,783,910 | 11/1988 | Boys, II et al. | 36/30 R X |
| 4,864,737 | 9/1989 | Marrello | 36/28 X |
| 4,897,936 | 2/1990 | Fuerst | 36/114 X |
| 4,918,838 | 4/1990 | Chang | 36/28 |

FOREIGN PATENT DOCUMENTS

| | | |
|---|---|---|
| 0111084 | of 0000 | European Pat. Off. . |
| 2492236 | of 0000 | France . |
| 2535950 | of 0000 | France . |

*Primary Examiner*—Paul T. Sewell
*Assistant Examiner*—Ted Kavanaugh
*Attorney, Agent, or Firm*—Darby & Darby

[57] ABSTRACT

An impact damping system for application to sport shoes having a hollow housing of flexible elastomeric material which is softer and more resilient than the insole material of the sport shoe which it is to be removably placed in a cavity in the heel area of the shoe. The inner and outer surfaces of the housing side which are smooth and homogeneous, and there is a top cover with an overhang lip which rests on the insole. One or more replaceable damping discs are inserted into the housing and are held therein by the cover which has downwardly extending pins to engage a groove in the disc and a peripheral flange at the lower end of the housing.

20 Claims, 2 Drawing Sheets

IMPACT DAMPING SYSTEM APPLICABLE TO SPORT SHOES

This is a continuation of application Ser. No. 429,802, filed Oct. 30, 1990, now abandoned.

BACKGROUND OF THE INVENTION

Sport or athletic shoes have been anatomically improved not only to guarantee a better performance with higher stability of a sportsman's movements but also to provide them more protection to their body support parts which are constantly under high stress and impact pressure.

To better absorb any impact at the heel area of a shoe, a known solution is to place one or more damping pieces into a cavity located at the inner part of the sport shoe, that is, in its insole at the area of the heel, which will absorb impacts applied to the heel.

Solution for sport shoes with soles suggest in the case of soft soles made of elastic synthetic material, the placement of one or more replaceable pieces having a greater hardness than that of the sole into a cavity at the heel area. This makes possible a graduation of the flexibility reduction of the sole and a graduation of the shock adsorption capacity at this area in accordance with the individual characteristics of the sportsman and the sport.

One of the solutions is the use of one or more cylindrical or annular discs made of a material which is harder than that of the insole and has areas of different hardnesses. These are placed into direct contact with the inner surfaces of the insole cavity which, being of a normally very soft material prevents the movement of the parts inserted in this area. insole cavity may also be provided with a central axial pin the same insole material over which the annular shaped discs fitted. This assembly is covered by an insole of the sport and helps the discs to be retained by the heel pressure. When the insole is raised, the disc can be removed by pullers (for instance ribbons) attached to the parts.

However, in the case of sport shoes with a sole made of relatively solid or hard elastic synthetic material, the insertion of a flexible material which is softer than that of the insole into a cavity at the heel area allows for flexibility graduation of the sole at this area in addition to absorbing impact and returning power to the heel area. An existing solution in this case is the use of a damping element, also being power restoring, in the shape of only one tubular piece made of flexible material defining an air pressurized inner chamber under a predetermined pressure. The user can fit and remove the damper into a cavity provided in the sole of the sport shoe at the heel area.

The retention of the damping element inside the cavity is provided by direct contact of the walls thereof with the side surface of the damping element. This solution does not allow any intermediary combinations of damping/impulse adjustment, which are readily obtained by means of a set of independent dampers combined to act together. Also the whole damper piece wears, not necessarily in a uniform way, by the direct friction of the hard walls of the cavity in the insole with the side surface of the damper during the axial elastic deformations to which the damper is subjected while the shoe is used.

The use of a plurality of damping discs with variable hardness which is much lower than that of the insole, and therefore, that of the inner walls of said insole, would allow that from a certain number of damping discs a larger variation with more precision in the flexibility of the sport shoe is obtained than that which would be obtained with the same number of air pressurized damping elements. However, the arrangement of a plurality of damping discs directly located inside the inner cavity at the heel area of a hard insole material is not adequate due to the fact that there discs have more friction with the inner walls of the cavity, causing an irregular and high degree of wear of the disc, loss of power to be returned and poor distribution of the compression force of the heel through the discs overlapped inside the cavity. Such an arrangement also impairs the compressed air to be ejected by the heel, therefore causing the temperature and moisture to increase at the heel area and further making it difficult for the user to put the discs into and remove them from the cavity.

BRIEF DESCRIPTION OF THE INVENTION

The invention provides an impact damping system for sport shoes of the type having an insole with the heel portion made of elastic synthetic material which is relatively solid or hard. The damping system allows for a fine and broad adjustment of the degree of damping and power return, which can be made by the user through interchangeable, damping elements selected from a set of a few such elements, without the drawbacks of the solutions given by the prior art.

The damping system of the invention is of the type having an elastically deformable damping means which is fittable in a removable way in a cavity provided for at least a portion of the height of the heel area of an insole made of elastic and relatively hard material. The cavity is open to the upper face of the insole which is covered by the shoe insole.

According to the invention, the damping system comprises a tubular housing made of flexible elastomeric material which is much softer than that of the insole. The housing has flat side walls which are removable fitted into the insole cavity. The housing also has an upper convex pierced cover, provided with an external peripheral rim to be seated on the edge of the insole surrounding the cavity and with a plurality of inner axial overhangs or projections placed in circular alignment. The hanging side walls carry a lower retention means for the damping elements and a determined number of replaceable damping elements. The damping elements have the shape of overlapped sides and one made of flexible elastomeric material which are softer than that of the insole and harder than that of the housing in which they are located. The damping elements are axially retained between the assembly of the axial overhangs of the cover and the lower retention means. The housing and the assembly of discs are dimensioned in such a way that, when mounted in the shoe, only the lower face of the disc in a lower position will be seated on the bottom of the cavity. The discs have the same dimensions but different degrees of hardness.

The material of the damping discs is designed to be able to obtain an appropriate adjustment in the degree of impact damping being received by said discs and of return of power to the user's body, through a simple selection of discs to be placed inside the housing.

In addition to the above advantage, the subject invention allows the housing to protect the discs against direct friction with the hard wall of the cavity in the insole. Also, the heel shock of the user will be transmitted and distributed in a homogeneous way to the discs and the sole, thereby avoiding relative and out of order movement of the discs, besides serving as a directing guide to the exhaust of air inside the housing to an area of the insole when the heel compressor makes a movement. The fact that the discs are positioned inside the housing which can be inserted into the cavity facilitates the replacement of the discs by the user.

BRIEF DESCRIPTION OF THE DRAWINGS

The invention will hereinafter be described by reference to the attached drawings, in which.

DETAILED DESCRIPTION OF THE INVENTION

Figure 1:
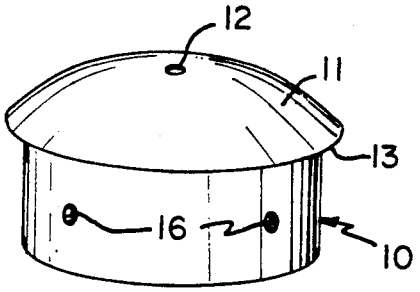
FIGS. 1 and 2 respectively represent a perspective view and a diametral vertical sectional view of the tubular housing.
Figure 2:
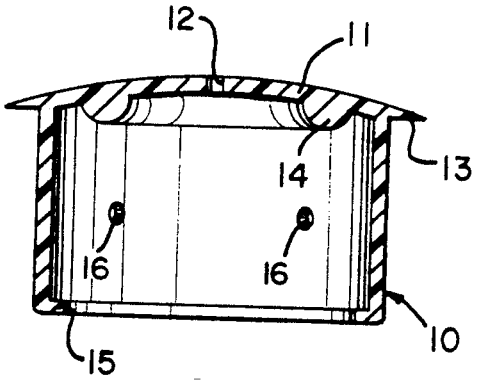
Figure 3:
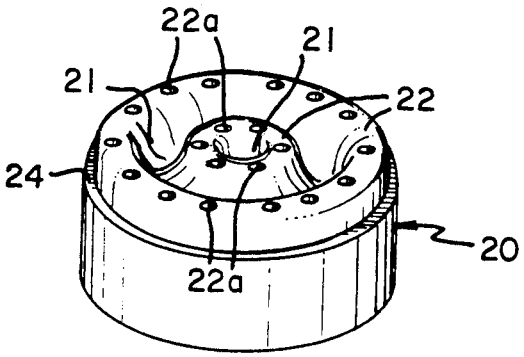
FIGS. 3 and 4 respectively represent a perspective view and a diametral sectional view of a damping disc in an inverted position.
Figure 4:
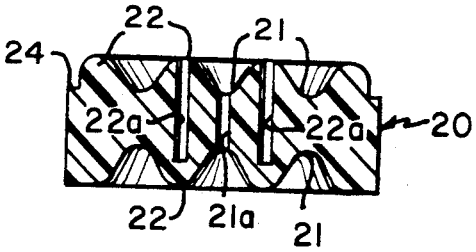

Referring to the drawings, the damping system of the invention is used in a sport shoe of the type having a sole made of an upper insole 1, a main insole 2 of elastic synthetic material which is relatively hard and a lower main outer sole 3 of elastomeric material on the face of which there are provided grooves and ribs defining the lower face of the sole. The three elements 1, 2 and 3 are bonded together by any suitable adhesive, heat sealing technique, etc.

The heel area, (see FIGS. 5–7) of the insole 2 is provided with a cylindric cavity 4 which is open at the top and closed at the bottom as illustrated in the described embodiment by the upper face of the sole 3. However, it is understood that the height of the cavity 4 and the shape thereof can be modified from the form shown.

The damping system includes a hollow housing 10 (see FIGS. 2–7), in this case having a cylindrical outer contour. The housing 10 is of flexible elastomeric material which is much softer than that of the insole 2. The inner and outer surfaces of the housing side wall are smooth. The housing is to be removably fitted in a relatively tight fit into the cavity 4 of the insole 2.

The housing 10 has an upper cover 11 with a convex outer surface (see FIGS. 1 and 2) provided at least with a central hole 12 for air exhaust and with an outer peripheral lip 13 which seats on the upper face of the insole surrounding the cavity 4 when the housing is fitted inside the cavity. The upper cover 11 has on its lower portion a plurality of downwardly extending axial overhangs or pins 14. In the embodiment shown, the overhangs 14 have the form of flexible cylindric pins arranged in circular alignment concentric to the central hole 12 in the upper cover. The function of the overhangs 14 is discussed below.

The cylindrical side wall of the housing 10 has adjacent to its lower edge on inwardly extending rib or flange 15 defining a retention means for the damping elements. It is understood that the flange 15 need not necessarily be continuous and it can be replaced by any other element, being integral or not with the housing body so long as it assures the retention of the damping elements inside the housing 10 while it is handled. For example, an insert piece can be used which is press flat into the bottom of the housing.

The side walls of the housing also can have holes 16 for air exhaust.

Figure 5:
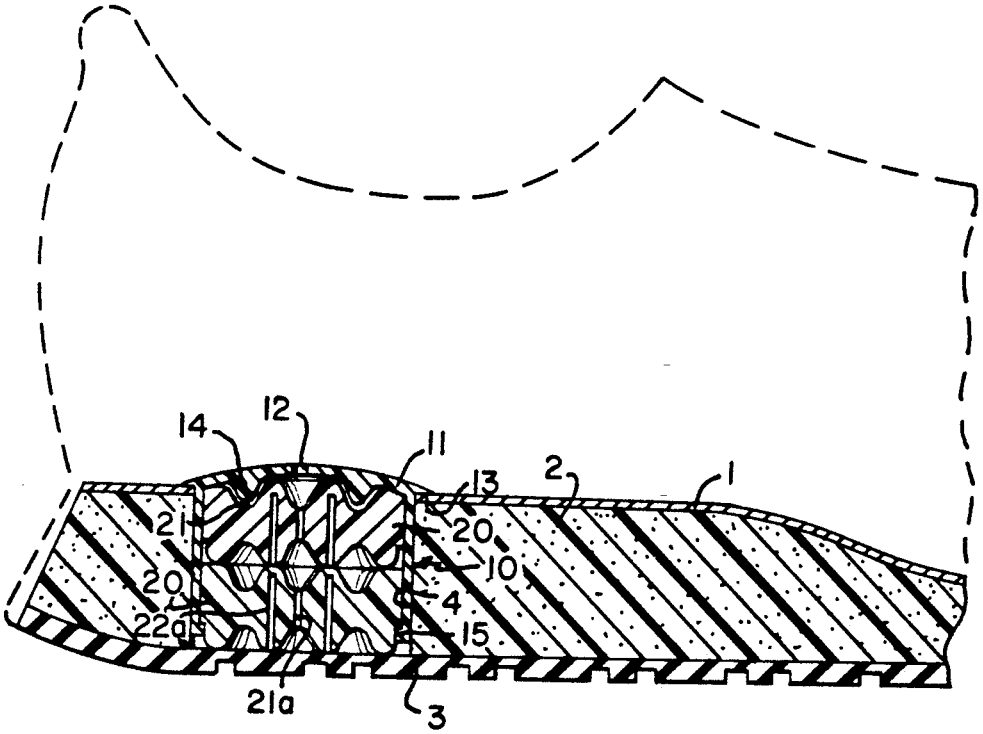
FIG. 5 shows a vertical, longitudinal, schematic and partial section of a shoe provided with the damping system of the invention.
Figure 6:
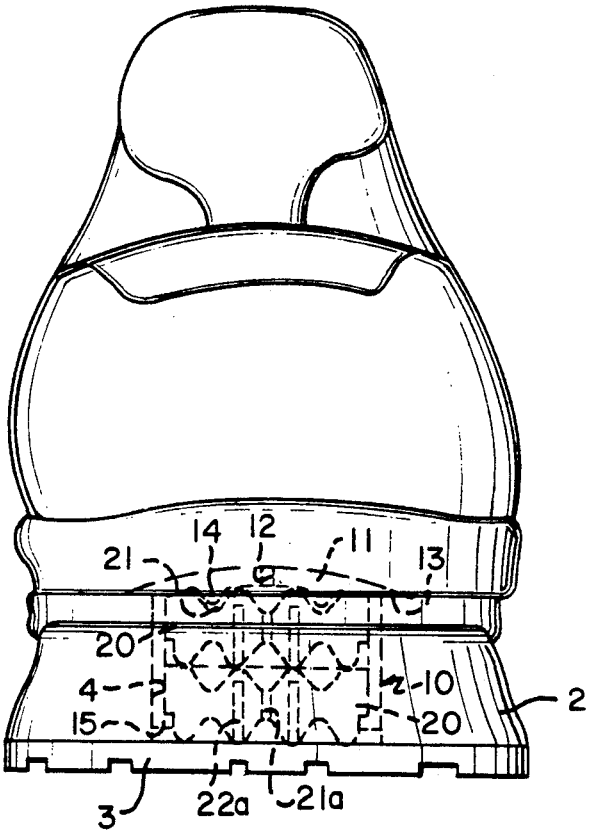
FIGS. 6 and 7 show, respectively, an end view and a transverse sectional view of a shoe provided with this damping system.
Figure 7:
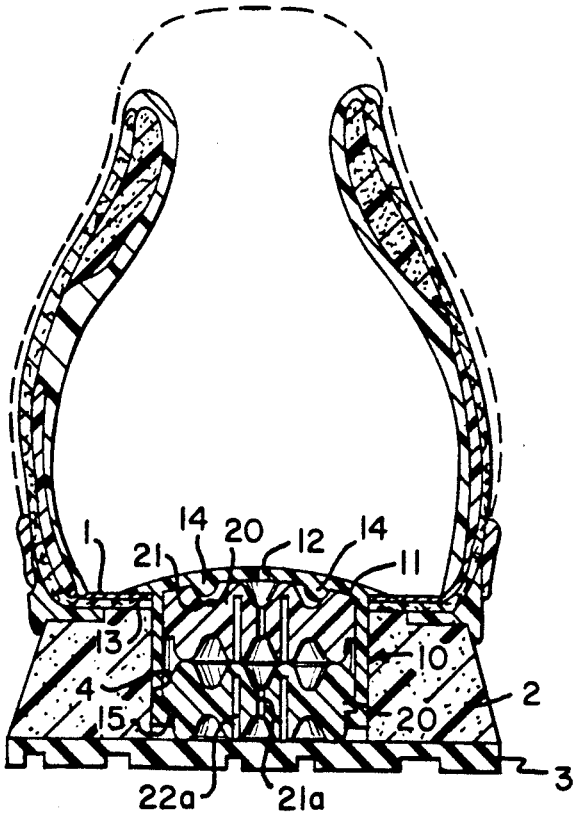

As can be seen in FIGS. 5, 6 and 7, the height of the side wall of the housing 10 is sized to be slightly smaller than the height of the cavity 4 in order that the bottom of the housing does not touch the top surface of the sole.

The other component of the damping system includes a plurality of discs 20 of flexible elastomeric material, which is softer and more resilient than that of the insole and harder and less resilient than the housing material. A plurality of annular concentric grooves 21 and ribs 22 alternate and are equally distributed on the upper and lower faces of the disc 20. In the preferred embodiment, the configuration of grooves and ribs on the upper and lower faces of the disc is the same. Each disc is also provided with axial through holes 21*a* interconnecting the grooves 21 in the opposed faces and axial holes 22*a* from the ribs 22 on one face of the disc terminating within the rib on the opposite face. The number and placement of the holes 21*a*, 22*a* are selected according to the degree of flexibility and venting as required at the heel area of the sport shoe. The ribs 22 form the support between adjacent damping discs which are stacked in the housing 10 and between the lower disc and the bottom of the cavity in the sport shoe.

The discs are also provided with a diametral peripheral reduction 24 on the lower face which can be continuous or in the form of overhangs and alternate recesses. These are axially distributed on the lower face peripheral edge of the damping discs thereby allowing a tight fit with the ribs or lower inner overhang flange 15 on the housing 10.

The number of damping discs 20 are used which can have the same or different change of flexibility. After choosing those damping discs which will produce the desired degree of flexibility, the user fits the discs inside the housing 10 which provides only one body which can easily by put into and removed from the insole cavity. The discs chosen by the user (in the illustrated example of FIGS. 5–7, being two) are selected from a set of discs (for example three) of selected different resiliency and hardness which are shipped with the sport shoe and preferably attached such as in a bag or envelope.

As can be seen in FIGS. 5, 6 and 7, the axial pins 14 of the housing cover 10 are arranged so that they fit into one of the grooves 21 on the upper face of the adjacent damping disc 10. This gives the assembly a higher degree of stability when compression and expansion movements are encountered.

The shape of the damping discs 20 with grooves and ribs 21 and 22 on the opposed faces thereof and also the axial inner holes 21*a* and 22*a* allow that during the operation of the assembly, in addition to the damping and return of power at the heel area, a ventilation for the shoe is obtained by the guided exhaust of the heated air insider the housing 10 to the insole area, thus avoiding an increase in temperature and moisture inside the sport shoe. That is, as the user applies force to the housing cover, the discs and housing are compressed. The residual air is expelled via the passages 21*a*, 22*a* in the discs, and the holes 16 in the housing and the hole 12 in the cover.

I claim:

1. An impact damping system for sport shoes of the type having an insole and a sole, a cavity formed in said insole and extending down to the upper face of the sole within the shoe, a hollow housing of resilient material shaped to fit in said cavity and to be removable therefrom, the bottom end of the housing extending toward said upper face of the sole, said housing having an integral cover at its upper end, the upper face of the cover mating with the upper face of the insole, the bottom of the housing having an inward peripheral extension leaving an opening, and at least one damping disc of resilient material in said housing extending between the inner face of said cover and the housing inward extension and toward the upper face of the sole, said at least one disc being insertable into said housing through the opening in the housing bottom by deforming the housing bottom.

2. An impact damping system as in claim 1 wherein said cover has a peripheral lip which engages the insole upper surface surrounding the cavity.

3. An impact damping system as in claim 2 wherein said cover has a generally convex outer surface.

4. An impact damping system as in claim 2 wherein said cover has at least one hole therein for the expelled air to pass when the housing and damping disc are compressed.

5. An impact damping system as in claim 3 wherein said cover has at least one hole therein for the expelled air to pass when the housing and damping disc are compressed.

6. An impact damping system as in claim 1 wherein the resilient material of the removable housing is softer than the material o the insole, and the damping disc is of a material which is harder than the housing material.

7. An impact damping system as in claim 1 wherein said cover has at least one projection downwardly extending from its inner surface to engage the upper surface of said at least one disc within the housing.

8. An impact damping system as in claim 1 wherein only the lower face of said at least one disc in the housing extends through the opening in the housing bottom and engages the upper face of the sole.

9. An impact damping system as in claim 8 wherein at least one face of said at least one disc has concentric, alternating annular ribs and grooves.

10. An impact damping system as in claim 9 wherein both faces of said at least one disc have the concentric alternating annular ribs and grooves.

11. An impact damping system as in claim 10 wherein said at least one disc with the concentric alternating annular ribs and grooves has axial holes connecting the grooves on the opposing faces of the disc.

12. The damping system of claim 11 wherein said at least one disc with the concentric alternating annular ribs and grooves has axial holes interconnecting the ribs on the opposed faces of the disc, the ribs of the lowermost disc in the housing engaging the upper face of the sole.

13. An impact damping system as in claim 12, wherein the axial holes in the grooves are through holes and extended from one face of said at least one disc to its other face.

14. An impact damping system according to claim 12, wherein the axial holes in the ribs extend from one face of said at least one disc partially into the interior of the ribs on the opposed face of the disc.

15. An impact damping system according to claim 12, wherein the said at least one disc is also provided with a peripheral diametral reduction at least in a portion of the peripheral edge of the lower face of the disc, and the housing has a lower inwardly extending retention means on which the peripheral diametral reduction rests.

16. An impact damping system according to claim 1, wherein the side wall of the housing has radial holes to exhaust air.

17. An impact damping system as in claim 1 wherein there are a plurality of said damping discs with materials of selected different flexibilities.

18. An impact damping system as in claim 15, wherein said housing retention means is above the upper face of the sole.

19. An impact damping system as in claim 8 wherein the bottom of the housing rests on a part of said insole and the said at least one disc engages the sole.

20. An impact damping system for sport shoes of the type having an insole and a sole, a cavity formed in said insole and extending down to the upper face of the sole within the shoe, a hollow housing of resilient material shaped to fit in said cavity and to be removable therefrom, the bottom end of the housing extending toward said upper face of the sole, a cover for the upper end of the housing and being integral therewith, the upper face of the cover mating with the upper surface of the insole, the bottom of the housing having an inward peripheral extension leaving an opening, and at least one damping disc of resilient material in said housing extending between the inner face of said cover and the housing inward extension extending toward upper face of the sole, said at least one disc being insertable into said housing through the opening in the housing bottom by deforming the housing bottom, the cover inner surface having a plurality of downwardly projecting cylindric pins concentrically distributed around a central hole in the cover, the upper face of said at least one disc having an annular groove on the upper surface and the pins fit into such groove and engage the upper face of the disc.

* * * * *